US007451882B2

(12) United States Patent
McKay

(10) Patent No.: US 7,451,882 B2
(45) Date of Patent: Nov. 18, 2008

(54) ARTICLE ORGANIZER

(76) Inventor: Regina P. McKay, 116 Hillcrest Ter., Roselle, NJ (US) 07203

( * ) Notice: Subject to any disclaimer, the term of this patent is extended or adjusted under 35 U.S.C. 154(b) by 287 days.

(21) Appl. No.: 10/951,219

(22) Filed: Sep. 27, 2004

(65) Prior Publication Data

US 2006/0065613 A1 Mar. 30, 2006

(51) Int. Cl.
*A47F 7/02* (2006.01)

(52) U.S. Cl. ..... 211/85.2

(58) Field of Classification Search ..... 211/85.2, 211/85.31, 85.29, 115, 163, 128.1, 131.1, 211/129.1
See application file for complete search history.

(56) References Cited

U.S. PATENT DOCUMENTS

| | | | | | |
|---|---|---|---|---|---|
| 303,177 | A * | 8/1884 | Miller | 108/30 |
| 1,711,587 | A * | 5/1929 | Brunhoff | 211/168 |
| 3,266,634 | A * | 8/1966 | Tintary | 211/131.1 |
| 3,421,762 | A * | 1/1969 | Mose | 273/339 |
| 4,121,720 | A | 10/1978 | Hayes | |
| 4,390,099 | A | 6/1983 | Trautlein et al. | |
| 4,838,625 | A * | 6/1989 | Taylor | 312/249.5 |
| 4,850,658 | A * | 7/1989 | Sandor | 312/225 |
| 4,936,466 | A | 6/1990 | Nava | |
| 5,054,624 | A * | 10/1991 | Camp | 211/85.2 |
| 5,168,985 | A | 12/1992 | Shih | |
| 5,692,601 | A | 12/1997 | Moss | |
| 5,833,080 | A * | 11/1998 | Donne | 211/85.31 |
| 5,839,586 | A * | 11/1998 | Smith | 211/163 |
| 5,848,710 | A | 12/1998 | Pomper | |
| 6,095,346 | A | 8/2000 | Idelberger | |
| 6,158,578 | A * | 12/2000 | Greiner | 206/6.1 |
| 6,241,105 | B1 * | 6/2001 | Pomper | 211/85.2 |

* cited by examiner

*Primary Examiner*—Sarah Purol
(74) *Attorney, Agent, or Firm*—Law Offices of Rita C. Chipperson, P.C.

(57) ABSTRACT

An article organizer for storing, organizing, and displaying jewelry and similar articles, comprising a shaft and a plurality of storage units mounted around the shaft, which storage units may be individually rotatable. Each storage unit may be a display assembly, a shelf, or a tray assembly. Each display assembly comprises a display hub and one or more spokes that extend from the hub. Necklaces, bracelets, chains and other elongated jewelry may be suspended from the spokes so as to display these jewelry items and prevent them from becoming entangled or knotted. To further reduce the tendency for two pieces of jewelry to become entangled, a spoke may have periodic, random, or other non-monotonic upward and downward bends. A tray assembly comprises one or more levels, with the top level comprising a tray or drawers, and each remaining level comprising drawers.

15 Claims, 7 Drawing Sheets

ARTICLE ORGANIZER

TECHNICAL FIELD OF THE INVENTION

The present invention relates to organizers and displays for jewelry and similar articles. More particularly, the present invention relates to an apparatus for storing, organizing, and displaying jewelry and the like. Although the invention is ideally suited for use with jewelry, it may also be used to store, organize, and/or display other similar objects such as watches, ties, keys, kitchen implements, etc.

BACKGROUND OF THE INVENTION

The present invention may be used in the home or a similar setting to provide an improved method and apparatus for storing, organizing, and displaying articles. Necklaces, bracelets, chains, and other elongated articles may be suspended from the spokes of the rotatable tiers to prevent these articles from tangling or becoming knotted. Other articles such as rings, pins, pendants, earrings, watches, and the like, that are not easily suspended, or that the user prefers not to store and display in such a manner, may be stored in a compartment or drawer of a lower level tier. Thus, the present invention stores, organizes, and displays multiple types of articles of varying sizes in one easily accessible and space saving location.

The following references, which are discussed below, were found to relate to the field of article storage and display: Hayes U.S. Pat. No. 4,121,720 ("Hayes"), Trautlein et al. U.S. Pat. No. 4,390,099 ("Trautlein"), Nava U.S. Pat. No. 4,936,466 ("Nava"), Shih U.S. Pat. No. 5,168,985 ("Shih"), Moss U.S. Pat. No. 5,692,601 ("Moss"), Pomper U.S. Pat. No. 5,848,710 ("Pomper"), and Idelberger U.S. Pat. No. 6,095,346 ("Idelberger").

Hayes discusses an apparatus for displaying jewelry that includes a plurality of vertically spaced and horizontally disposed display rings retained in a concentric orientation by a center support rod and a plurality of connecting members extending between adjacent rings. At least one of the rings has a plurality of outwardly protruding fingers adapted to support ring-type jewelry while other of the display rings include hook means for supporting bracelets, necklaces and the like and openings therethrough for receiving earrings.

Trautlein discusses a display stand for holding jewelry or similar articles including a circular display member having one or more separations through which articles may be slid to position the articles on the display member. Sleeves are mounted slidably on and arced identically to the display member such that the sleeve slides between an open and closed position with respect to the separations. A user may slide the sleeve between locked and unlocked positions with respect to the separation such that articles suspended on the separation may not be removed when the sleeve is closed, but may be removed when the sleeve is open.

Nava discusses a holder for jewelry items and watches that includes illumination and an upwardly mounted support member for storing and displaying these items. A base with a flat surface is provided for both structural integrity and to house the batteries and/or wires that provide the electrical energy to the holder's illuminating device. A horizontal support member includes bends to allow watches or other similar items to be positioned thereon. Also, a hook member is rigidly mounted to the underside of the horizontal member such that other jewelry items can be suspended from it. Furthermore, one or more frustoconical members are rigidly mounted to the vertical support members for holding rings and other similar items.

Shih discusses a jewel box including, inter alia, a base, an enclosure, a hanger, and a cover. The hanger and cover are affixed to a telescopic tube such that removing the cover from a corresponding aperture in the enclosure in an upward motion with respect to the base causes jewelry suspended on the hanger to be removed from the enclosure for access by the user. When the cover is replaced in the enclosure aperture, jewelry suspended on the hanger re-enters the enclosure and is protected from environmental particles such as dirt, moisture, etc.

Moss discusses a storage container for elongated pieces of jewelry. The storage container includes a base having a cover and rigid jewelry support rods attached to the upwardly facing surface of the base. The cover may be removed from the base to display jewelry hanging on the support rods. Moreover, the cover may be rotated with respect to the base, and a closeable opening in the cover allows access to elongated pieces of jewelry stored on the distal ends of the jewelry support rods without removing the cover from the base.

Pomper discusses a merchandise display stand having a vertical post assembly mounted on a horizontal base, spokes mounted on the upper end of the vertical post assembly upon which merchandise may be hung, and a separate continuous ring. The spokes and the ring move relative to each other between a first position in which the ring abuts with the ends of the spokes such that merchandise may not be freely removed from the spokes and a second position in which space exists between the ring and one or more of the spokes such that the merchandise may be freely removed from the spoke.

Idelberger discusses a combination display and donning facilitator for use with a bracelet having interlocking ends. The combination includes a base that rests on a horizontal surface, a post that extends upwardly from the base, and an arm that extends across the post parallel to the base. The arm includes an alligator clip that releasably grasps an end of a bracelet to facilitate donning of the bracelet. After the bracelet is donned on the user, it may be released from the alligator clip.

As illustrated above, the prior art is completely devoid of methods and apparatus for organizing, storing, and displaying articles that include one or more stationary or rotatable tiers for both suspending and storing articles within one or more compartments or drawers.

In addition, the prior art does not contain methods and apparatus for organizing, storing, and displaying articles that includes one or more stationary or rotatable tiers for both suspending and storing articles within one or more compartments or drawers, wherein the tiers have vertically adjustable heights.

Further, the prior art fails to disclose methods and apparatus for organizing, storing, and displaying articles that includes spokes having a plurality of bends that prevent articles stored on the spoke from sliding toward and entangling with adjacent articles.

Moreover, the prior art fails to disclose methods and apparatus for organizing, storing, and displaying articles that includes drawers configured to minimize the outer diameter, or the width and length, of the storage device.

Thus, in light of the prior art discussed herein, there is a clear need for a method and apparatus for storing, organizing and displaying articles that combines all of the aforementioned features to allow multiple types of articles to be stored and displayed in one easily accessible and space saving location.

SUMMARY OF THE INVENTION

The present invention relates to methods and apparatus for storing, organizing, and displaying articles such as jewelry in a space saving manner. Also, the present invention allows a user to choose different methods of storage for different types of articles. The present invention is further designed to prevent elongated jewelry from becoming entangled or knotted, and to provide different types of storage to accommodate different types of articles. Furthermore, the present invention provides ease of access and display to facilitate selection and retrieval of stored articles.

The present invention comprises a shaft and one or more stationary or individually rotatable tiers coupled to the shaft at varying vertical heights. Each tier intended for suspension of articles comprises a hub and one or more spokes that extend radially from the hub. A proximal end of each spoke is attached to the hub, and the height at which the hub is coupled to the shaft is adjustable by the user. Necklaces, bracelets, chains, and other elongated articles may be suspended from the spokes to display the articles and store them in a manner that prevents them from becoming entangled or knotted. Optionally, to minimize the tendency for two adjacent articles to slide into one another and become entangled, one or more of the spokes may be shaped in a jagged configuration to provide a plurality of periodic, random, or otherwise alternating upward and downward bends. In addition, the distal ends of the spokes may be bent upwards to reduce the tendency for jewelry to slide off the distal end of the spokes during movement of the article organizer.

Each tier having compartments or drawers includes one or more vertically stacked levels supported by a platform. The top level may include trays, drawers, or some combination of the two. Each tray may comprise one or more compartments, and the individual compartments may either be open to the environment or may have a lid. The lower levels of the tray assembly (i.e., all levels other than the top level) comprise drawers. A drawer may be hinged to the frame of the tray assembly such that the drawer may be completely removed from the inside of the frame yet remain supported. Alternatively, a drawer may slide in and out of the frame of the tray assembly. By rotating the tray assembly around the shaft and/or by swinging the drawer on the hinge, the drawer may be placed in various positions to facilitate access to the drawer's contents. Furthermore, the article organizer may be supported by horizontal, lateral, or overhead surfaces.

Unlike the present invention as summarized above, traditional approaches to storing, organizing and displaying jewelry have created many problems including inefficient use of space, a tendency for jewelry to be entangled or knotted, an inability to effectively store the full panoply of jewelry types owned by most jewelry users, and a lack of convenient access for locating, selecting and storing jewelry.

One object of the present invention is to provide an improved method and apparatus for storing, organizing and displaying jewelry articles. Another object of this invention is to provide a method and apparatus for storing, organizing and displaying jewelry so as to keep necklaces, bracelets and other elongated jewelry from tangling and becoming knotted, while at the same time storing other types of jewelry such as rings, pins, pendants, earrings, watches and the like. It is also an object of this invention to provide a method and apparatus for storing, organizing and displaying jewelry that is convenient and easy to use. Furthermore, it is an object of this invention to provide a method and apparatus for storing, organizing and displaying jewelry in one easily accessible and space saving location. Moreover, it is an object of the present invention to provide a method and apparatus for storing, organizing and displaying jewelry that is simple in construction, aesthetically appealing and relatively inexpensive to manufacture.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

BRIEF DESCRIPTION OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which.

DETAILED DESCRIPTION OF THE PREFERRED EMBODIMENT

As required, a detailed illustrative embodiment of the present invention is disclosed herein. However, techniques, systems and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein, which define the scope of the present invention. The following presents a detailed description of the preferred embodiment (as well as some alternative embodiments) of the present invention.

Figure 1A:
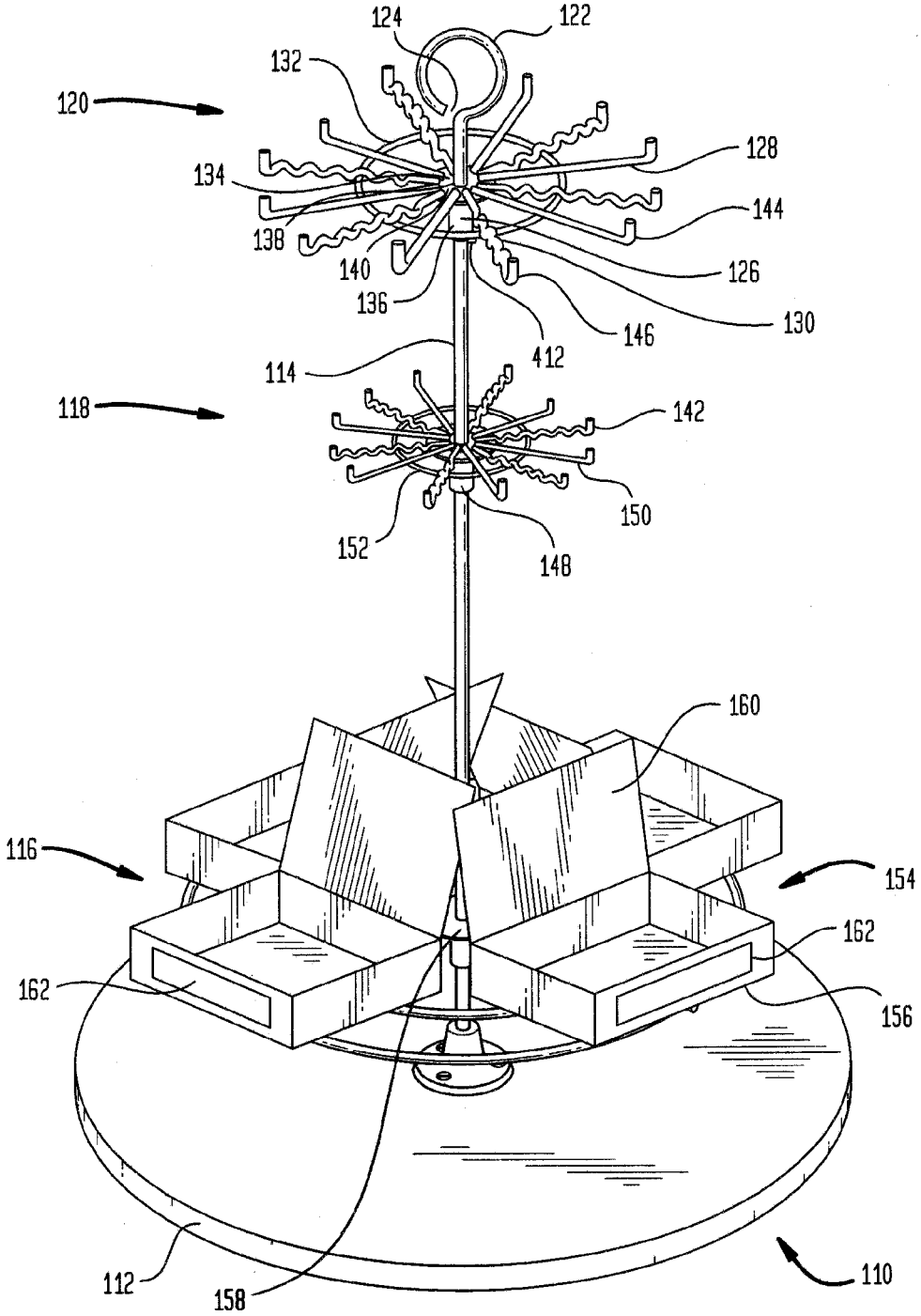
FIG. 1A is a perspective view of the article organizer in accordance with the preferred embodiment of the present invention including, inter alia, a base, shaft, and three tiers.

Referring first to FIG. 1A, depicted is article organizer 110 in accordance with the preferred embodiment of the present invention. Article organizer 110 includes, inter alia, base 112, shaft 114, lower, middle, and upper tiers 116, 118, and 120, respectively. In the preferred embodiment of the present invention, shaft 114 is cylindrical and, when shaft 114 is in an upright position, has threaded shaft end 212 at its lower end and handle 122 at its upper end. Shaft 114 is coupled to base 112 by threading threaded shaft end 212 (FIG. 2B) into brace 210 (FIGS. 2A, 2B), as discussed in greater detail below with respect to FIGS. 2A and 2B. Shaft 114 extends vertically through central apertures of lower, middle, and upper tiers 116, 118, and 120, respectively. At is upper end, shaft 114 is curved to form handle 122. Although shaft 114 of the preferred embodiment of the present invention is a single, primarily straight segment, other configurations are possible. For example, shaft 114 could branch such that each branch passes through one or more tiers (e.g., lower tier 116, middle tier 118, and upper tier 120). In this embodiment, the tiers are not vertically aligned.

The upper end of shaft 114 is curved such that handle 122 is formed. Handle 122 is circular having gap 124 at the point where the upper end of shaft 114 would intersect with a lower portion of shaft 114 if a complete circle were formed. Gap 124 allows article organizer 110 to be suspended by one or more suspension mechanisms (e.g., rope, clip, hook, etc.) by simply sliding gap 124 over the suspension mechanism. Alternatively, handle 122 may be used to facilitate transport of article organizer 110. In alternate embodiments, shaft 114 is not curved at its upper end. Rather, an independent handle mechanism is attached to the upper end of shaft 114. Or, in yet another alternate embodiment, handle 122 is simply omitted.

Still referring to FIG. 1A, in accordance with the preferred embodiment of the present invention, upper tier 120 includes upper tier hub 126, a plurality of straight upper tier spokes 128 alternating with a plurality of jagged upper tier spokes 130, and a single upper tier concentric member 132. The term "spoke" as used herein is defined as any element upon which an article may be hung and is not limited to those elements resembling a spoke of a wheel or that radiate from a central hub. Although the latter definition may be applied to the preferred embodiment of the present invention, alternate embodiments are envisioned in which the "spokes" are not radially configured. For example, the spokes may be configured to form a square or rectangle.

Upper tier hub 126 includes upper tier hub upper section 134 and upper tier hub lower section 136. Upper tier hub upper section 134 is a relatively flat disc containing a centrally located aperture 138 through which shaft 114 passes. The proximal ends of each of straight and jagged upper tier spokes 128 and 130, respectively, are affixed to upwardly facing surface 140 of upper tier hub upper section 134 such that they extend from upper tier hub 126 in a radial direction perpendicular to shaft 114. Upper tier hub upper section 134 is affixed to the upwardly facing surface of upper tier hub lower section 136, the latter of which is cylindrical and has an axial bore through its center that aligns with aperture 138 of upper tier hub upper section 134 such that shaft 114 is able to pass completely through upper tier hub 126.

Although in the preferred embodiment of the present invention straight and jagged upper tier spokes 128 and 130, respectively, extend perpendicularly to shaft 114, alternate embodiments are envisioned in which they are attached at an angle other than 90 degrees. Moreover, although straight upper tier spokes 128 are primarily straight (i.e., with the exception of straight and jagged upper tier spoke distal ends 144 and 146, respectively), they may also be created with an alternative design. For example, straight upper tier spokes 128 may be arced, wavy, spiral, sawtooth, sinusoidal, etc. for decorative or other reasons. Finally, albeit upper tier hub 126 of the preferred embodiment of the present invention is round, alternate shapes may be used without departing from the spirit of the present invention. For example, it may be shaped as a polygon, such as a square or octagon.

Furthermore, in the preferred embodiment of the present invention, upper tier hub 126 is fitted around shaft 114 such that upper tier 120 sits atop stop 412 (FIGS. 4A, 4B) and freely rotates about shaft 114. Although upper tier 120 rotates with respect to shaft 114 in the preferred embodiment of the present invention, alternate embodiments are envisioned in which upper tier 120 is stationary with respect to shaft 114.

Straight and jagged upper tier spokes 128 and 130, respectively, allow articles, preferably elongated articles such as necklaces, bracelets, watches, etc. to be suspended to provide organization and display of these articles in a manner that prevents the articles from becoming knotted, damaged, or entangled with adjacent articles. Additionally, the display features of article organizer 110 allow organized articles to be easily located and retrieved. To accommodate this use, the preferred embodiment of the present invention includes straight and jagged upper tier spoke distal ends 144 and 146, respectively, which are bent upwardly perpendicular to the respective straight or jagged upper tier spoke 128 or 130, respectively, to allow articles to be organized and stored throughout their entire length while preventing articles stored toward straight and jagged upper tier spoke distal ends 144 and 146, respectively, from inadvertently sliding off them during movement of article organizer 110.

Similarly, jagged upper tier spoke 130 is designed to further minimize the sliding of a stored or organized article along jagged upper tier spoke 130 during movement of article organizer 110. Sliding of stored or organized articles is undesirable due to the proclivity of these articles, especially necklaces, bracelets, and the like, to become entwined or tangled when stored adjacent to each other. Therefore, jagged upper tier spoke 130 is curved into upward and downward bends such that monotonic valleys are created into which articles may be placed for suspension on jagged upper tier spoke 130. The upward bends on either side of each valley impede movement of an article along the length of jagged upper tier spoke 130.

Although FIG. 1A depicts alternating jagged upper tier spokes 130 and straight upper tier spokes 128, article organizer 110 may be created with any combination and/or quantity of jagged and straight upper tier spokes 130 and 128, respectively, without departing from the scope of the present invention. Furthermore, although jagged upper tier spoke 130 of the preferred embodiment of the present invention contains monotonic valleys, alternate embodiments are envisioned containing periodic or random, non-monotonic valleys. Similarly, although jagged upper tier spoke 130 of the preferred embodiment of the present invention contains arced valleys, alternate embodiments are envisioned in which non-arced valleys perform the same function as the arced valleys. For example, the valleys could be square and formed from sawtooth bends.

Upper tier concentric member 132 is mounted beneath and affixed individually to each of straight and jagged upper tier spokes 128 and 130, respectively, at their respective midpoints to provide structural support and rigidity and to increase the weight-bearing capacity of the proximal ends of the straight and jagged upper tier spokes 128 and 130, respectively. Although upper tier concentric member 132 is provided primarily for structural support for upper tier 120, it also provides an additional element upon which articles may be hung.

Although upper tier concentric member 132 is included in the preferred embodiment of the present invention, alternate embodiments of the present invention exist in which upper tier concentric member 132 is not included (i.e., upper tier 120 includes only upper tier hub 126 and some combination of straight upper tier spokes 128 and jagged upper tier spokes 130) or wherein a plurality of upper tier concentric members 132 are included to provide greater strength, additional elements upon which articles may be hung, aesthetic appeal, etc.

Similar to upper tier 120, middle tier 118 includes middle tier hub 148, a plurality of alternating straight middle tier spokes 150 and jagged middle tier spokes 142, and a single middle tier concentric member 152. In the preferred embodiment of the present invention, middle tier hub 148 is identical to upper tier hub 126, and is configured as described above with respect to upper tier hub 126. Also, straight and jagged middle tier spokes 150 and 142, respectively, and middle tier concentric member 152 are identical to straight and jagged upper tier spokes 128 and 130, respectively, and upper tier concentric member 132 with one exception: the length of straight and jagged middle tier spokes 150 and 142, respectively, and the diameter of middle tier concentric member 152 are less than the respective components of upper tier 120. This spatial relationship is designed intentionally to allow shorter articles to be hung on middle tier 118 in close proximity to shaft 114, and to allow longer articles to be hung on upper tier 120 at a farther distance from shaft 114 such that the longer articles suspended from upper tier 120 hang around the perimeter of middle tier 118 and, therefore, do not touch or tangle with other article handing on middle tier 118 when article organizer 110 is in an upright position.

The configuration of middle tier 118 has not been discussed in detail because it is identical to upper tier 120. However, it should be noted that all of the alternate embodiments discussed herein with respect to upper tier 120 also apply to the respective elements of middle tier 118.

In accordance with an alternate embodiment of the present invention, middle tier 118 has a larger diameter than upper tier 120. In this alternate embodiment, article organizer 110 will typically have a longer shaft 114, thereby increasing the overall height of article organizer 110, to allow longer articles to be hung from upper tier 120 such that the articles do not hang around the perimeter of middle tier 118. In other words, upper tier 120 is located at a higher level on a longer shaft 114 to allow longer articles to be hung on upper tier 120 without the bottom of such articles reaching the point at which middle tier 118 is affixed to shaft 114. In this embodiment, shorter articles are hung on middle tier 118 and may be accessed without moving articles hanging from upper tier 120 about the perimeter of the lower articles. In yet another alternate embodiment, middle tier 118 is located at a height higher than upper tier 120 on vertical shaft 114.

Lower tier 116 comprises platform 154, compartments 156, and lower tier hub 158, wherein compartments 156 sit atop and are individually affixed to platform 154, which rests upon lower tier hub 158, as discussed in greater detail below with respect to FIG. 3.

Compartments 156 of the preferred embodiment of the present invention are square and situated in an equidistant manner around the perimeter of platform 154. Each compartment 156 has a dedicated cover 160 foldably attached to compartment 156, as depicted in FIG. 1A. The size of compartment 156 varies, however, in the preferred embodiment, each compartment 156 is three inches wide, three inches long, and 1.5 inches high.

Cover 160, in its closed position, prevents dust and other contaminants from entering compartment 156, thereby keeping the contents of compartment 156 clean and dust-free. Furthermore, cover 160 provides privacy with respect to the contents of compartment 156. Although cover 160 is foldably connected to its respective compartment 156, alternate embodiments are envisioned in which cover 160 is connected to its respective compartment 156 via one or more hinges, bindings, etc.

Furthermore, in accordance with the preferred embodiment of the present invention, the face of each compartment 156 contains holder 162 into which labels may be inserted to identify characteristics of the box (e.g., contents, user, etc.). However, alternate embodiments are envisioned in which compartments 156 do not have holders 162, or only a portion of compartments 156 included holders 162.

The individual components of lower tier 116, middle tier 118 and upper tier 120, as well as shaft 114, may be manufactured using any one of a variety of commercially available materials known in the art including, but not limited to, metal, wood, and plastic.

Although article organizer 110 is illustrated with three tiers (i.e., lower tier 116, middle tier 118, and upper tier 120), alternate embodiments of the present invention are envisioned having a single tier, equal diameter middle and upper tiers 118 and 120, respectively, a greater quantity of tiers wherein the tiers have identical or varying diameters, and/or tiers having varying compositions. More specifically, each of the additional tiers would be affixed to shaft 114 in the same manner described herein for the original lower tier 116, middle tier 118, or upper tier 120, however, the additional tier(s) would be affixed to shaft 114 at varying vertical heights. The height of shaft 114 can also be increased to accommodate a larger quantity of tiers. Furthermore, as described above with respect to the preferred embodiment of the present invention, each of these elements may be attached to shaft 114 in a stationary or rotatable manner.

Figure 1B:
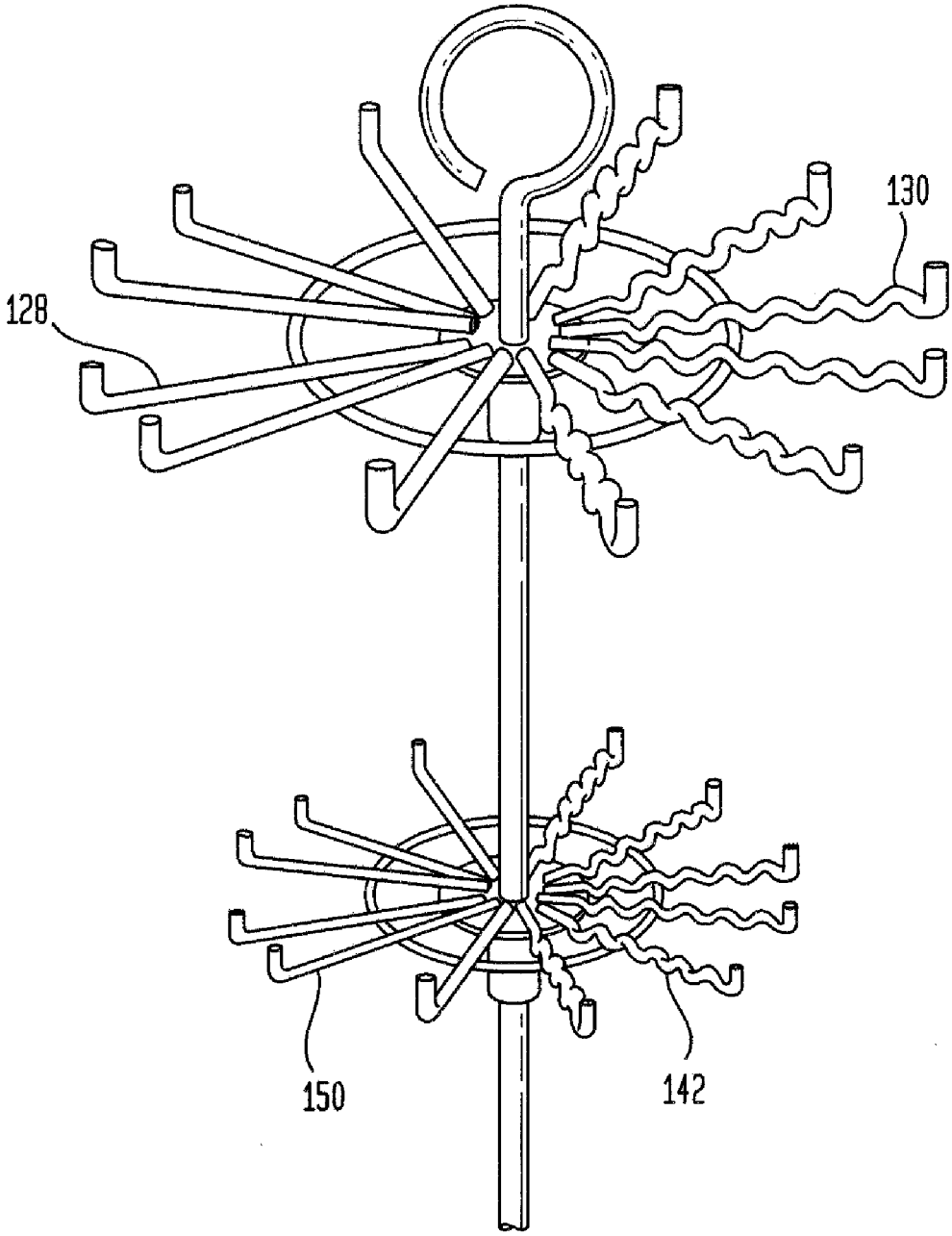
FIG. 1B is a perspective view of the top two tiers of the article organizer in accordance with an alternate embodiment of the present invention in which one half of each of the top two tiers consists entirely of straight spokes and the remaining half of each of the two tiers consists entirely of jagged spokes.

Turning now to FIG. 1B, depicted is an alternate embodiment for upper and middle tiers 120 and 118, respectively. In this alternate embodiment, one half of upper tier 120 consists entirely of straight upper tier spokes 128 and the remaining half of upper tier 120 consists entirely of jagged upper tier spokes 130 (i.e., straight and jagged upper tier spokes 128 and 130, respectively, do not alternate). Similarly, one half of middle tier 118 consists entirely of straight middle tier spokes 150 and the remaining half of middle tier 118 consists entirely of jagged middle tier spokes 142 (i.e., straight and jagged middle tier spokes 150 and 142, respectively, do not alternate).

Figure 2A:
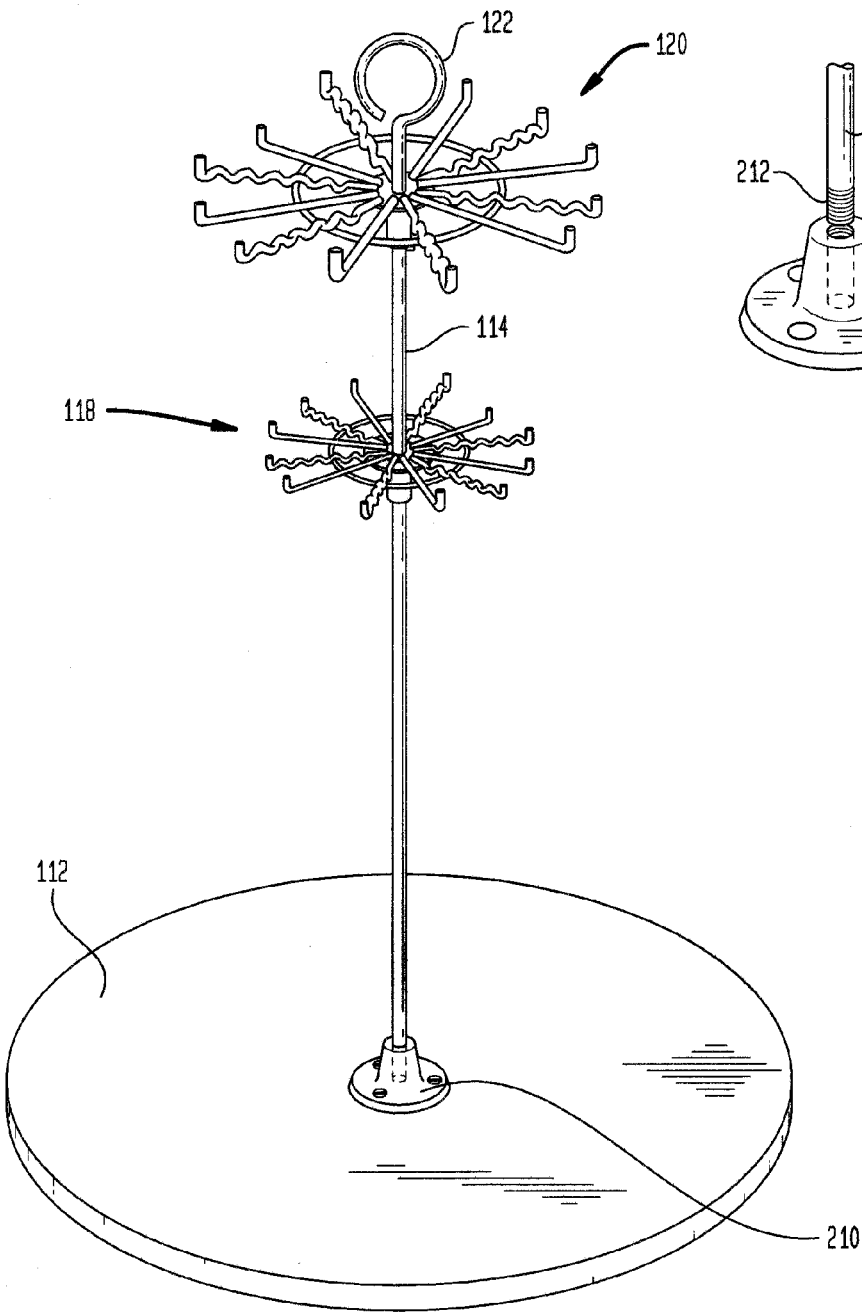
FIG. 2A is a perspective view of the article organizer shown in FIG. 1A in accordance with the preferred embodiment of the present invention with the lowest tier removed to provide an unobstructed view of the base.

Referring next to FIG. 2A, in accordance with the preferred embodiment of the present invention, depicted is an unobstructed view of base 112 and brace 210, the latter of which is affixed to the center of base 112 using screws, bolts, or any other appropriate attachment means known in the art. However, alternate embodiments are envisioned in which base 112 attaches to shaft 114 via a swivel to allow both base 112 and shaft 114 to pivot freely.

Preferably, base 112 is manufactured of a heavy wood, such as oak. However, other types of sturdy and heavy materials (e.g., steel, titanium, plastic, etc.) are also suitable. Base 112 is designed to be heavy with respect to the other components of article organizer 110 (FIG. 1A) primarily to provide stability, although greater durability and strength are also achieved.

Furthermore, incorporating a circular base 112 having a larger diameter than any of the tiers affixed to shaft 114 (i.e., lower tier 116 (FIG. 1A), middle tier 118, and upper tier 120) increases the stability of article organizer 110 (FIG. 1A). The design of base 112 is intended to prevent article organizer 110 (FIG. 1A) from tipping over during normal use. Although base 112 is circular, alternate embodiments may include a non-circular base 112. For example, base 112 may also be square, or may be equipped with legs.

Figure 2B:
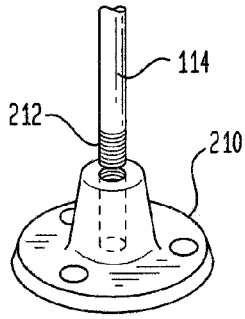
FIG. 2B is an exploded view of the brace and the threaded end of the shaft of the article organizer shown in FIG. 1A in accordance with the preferred embodiment of the present invention.

As depicted in greater detail in FIG. 2B, brace 210 of the preferred embodiment of the present invention is threaded on its upper end to allow threaded shaft end 212 to be threaded into brace 210. The threading of these components allows a user to connect and disconnect base 112 (FIG. 2A) via brace 210 at will, thereby, allowing the user to add or remove tiers to article organizer 110 (FIG. 1A) on an as needed basis. That is, to increase the quantity of tiers, a user simply removes shaft 114 from brace 210 and inserts shaft 114 through each additional tier. One stop 412 (FIG. 4) per tier is then inserted in the shaft bore 410 (FIG. 4) below the desired height of the additional tier. The tier is then rested atop stop 412 (FIG. 4). Similarly, tiers may be removed by unthreading shaft 114 from brace 210, removing the stop 412 (FIG. 4) associated with the tier to be removed from its shaft bore 410 (FIG. 4), and simply sliding the tier to be removed until it no longer surrounds shaft 114. In addition, the method of adding and removing tiers discussed above can be combined to rearrange the positions of tiers already mounted on shaft 114.

Referring back to FIG. 2A, although the preferred embodiment of the present invention includes a base 112 and brace 210, alternate embodiments are envisioned in which threaded shaft end 212 threads directly into base 112 in either a rotatable or stationary manner, and brace 210 is not required. Moreover, base 112 and shaft 114 could be formed as a single unitized piece. In this scenario, handle 122 could be removed to allow additional tiers to be added to shaft 114 over the top of shaft 114. Finally, base 112 could be omitted entirely, using handle 122 to affix or suspended article organizer 110 (FIG. 1A) from an overhead or lateral surface.

Figure 3:
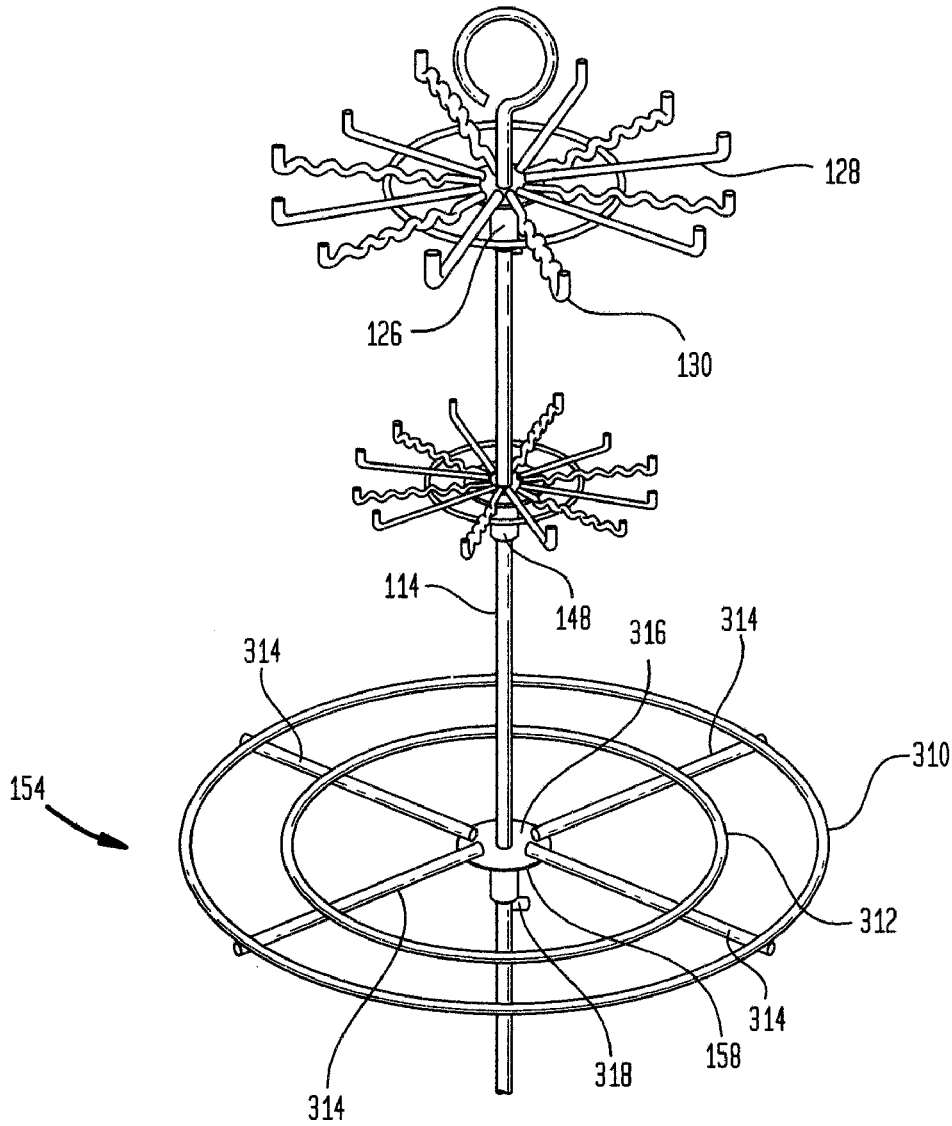
FIG. 3 is a perspective view of the article organizer shown in FIG. 1A in accordance with the preferred embodiment of the present invention with the base and compartments removed to provide an unobstructed view of the lower tier platform.

Turning now to FIG. 3, platform 154 includes lower tier hub 158, outer platform concentric member 310, inner platform concentric member 312, and a plurality of platform spokes 314. For ease of manufacturing, lower tier hub 158 is identical to upper tier hub 126 and middle tier hub 148. Similar to straight and jagged upper tier spokes 128 and 130, respectively, the proximal ends of each of platform spokes 314 are affixed to upwardly facing surface 316 of lower tier hub 158 such that each of platform spokes 314 emanates from lower tier hub 158 in a radial direction perpendicular to shaft 114.

Furthermore, in the preferred embodiment of the present invention, lower tier hub 158 is fitted around shaft 114 such that lower tier hub 158, and consequently all of lower tier 116 (FIG. 1A), sits atop lower tier stop 318 and freely rotates about shaft 114. Although in the preferred embodiment of the present invention lower tier 116 (FIG. 1A) rotates with respect to shaft 114, alternate embodiments are envisioned in which lower tier 116 (FIG. 1A) is stationary with respect to shaft 114.

Outer and inner platform concentric members 310 and 312, respectively, are mounted above and affixed individually to each of platform spokes 314 as illustrated in FIG. 3. More specifically, outer platform concentric member 310 is affixed at the distal ends of each of platform spokes 314, and inner platform concentric member 312 is affixed to each platform spoke 314 at a distance approximately one-third of the length of platform spoke 314 from its distal end. Outer and inner platform concentric members 310 and 312, respectively, provide structural support and rigidity, and increase the weight-bearing capacity of platform 154. Although outer and inner platform concentric members 310 and 312, respectively, are provided primarily for structural support for platform 154, they also provide additional elements upon which articles may be placed.

Compartments 156 (FIG. 1A) sit atop and are individually attached to platform 154. More specifically, each compartment 156 (FIG. 1A) sits upon and is affixed to a respective platform spoke 314, as well as both outer and inner platform concentric members 310 and 312, respectively. The front of each compartment 156 (FIG. 1A) protrudes beyond the perimeter of outer platform concentric member 310 to accommodate larger compartments 156 (FIG. 1A). Platform 154 and its associated compartments 156 (FIG. 1A) rotate freely with respect to stand 114.

It should be noted that alternative shapes, configurations, and constructions of platform 154 are possible without departing from the scope of the present invention. For example, in lieu of outer and inner platform concentric members 310 and 312, respectively, and platform spokes 314, platform 154 may be constructed of a solid piece containing a central aperture through which shaft 114 may pass. Moreover, the platform 154 may be a polygon (e.g., a square, octagon, etc.) rather than a circle. Finally, article organizer 110 (FIG. 1A) could be adapted to include zero or more than one lower tier 116 (FIG. 1A).

Figure 4A:
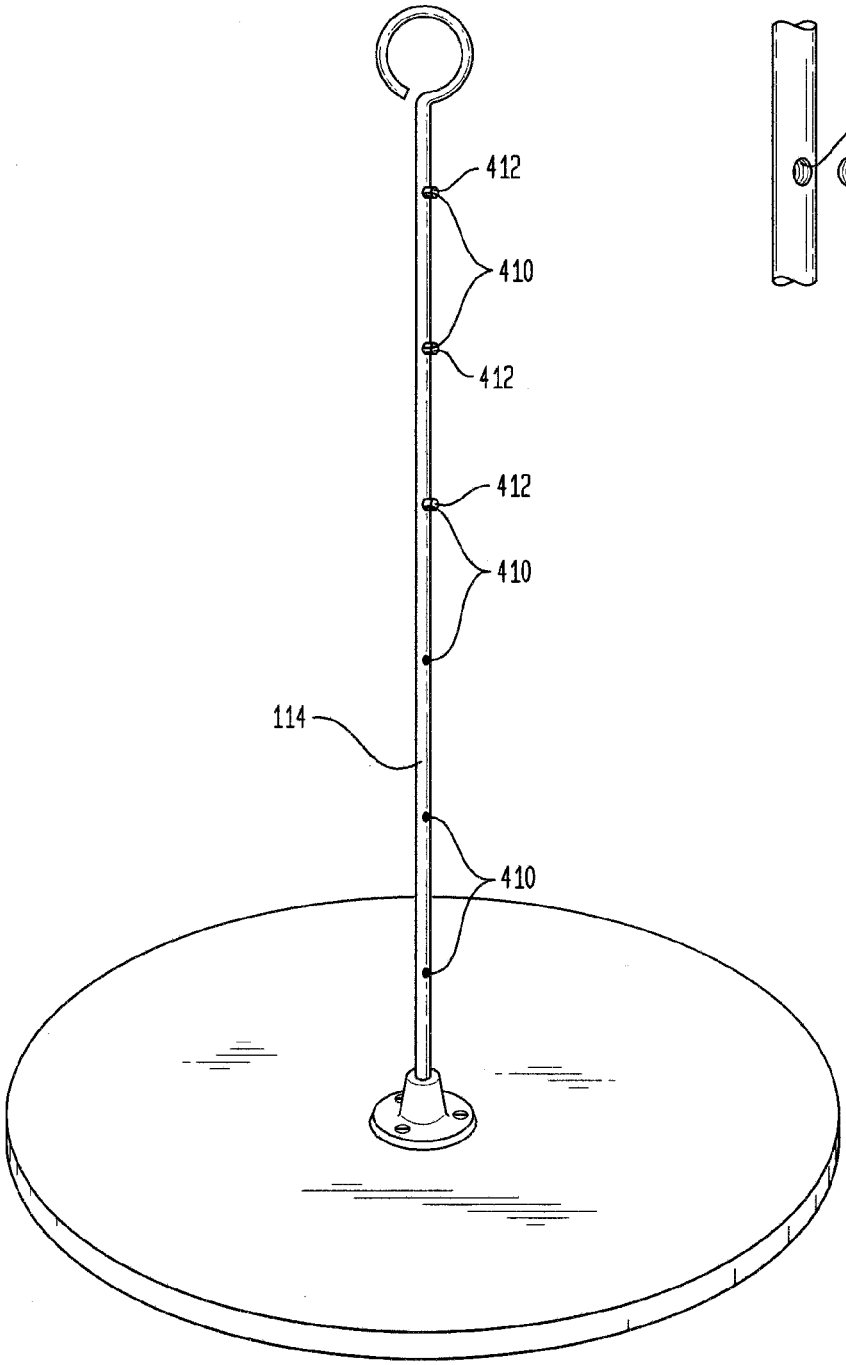
FIG. 4A is a perspective view of the article organizer shown in FIG. 1A in accordance with the preferred embodiment of the present invention with all three tiers removed to provide an unobstructed view of the shaft including shaft bores and stops.
Figure 4B:
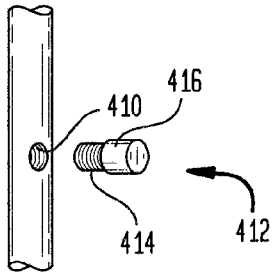
FIG. 4B is an exploded view of a bore and a stop of the article organizer shown in FIG. 1A in accordance with the preferred embodiment of the present invention.

Referring now to FIG. 4A, shown is a plurality of shaft bores 410 penetrating approximately three-quarters through shaft 114 and located at regular intervals along the length of shaft 114. Also, depicted in detail in FIG. 4B, are stops 412 including threaded shank 414 and head 416.

Referring back to FIG. 4A, shaft bores 410 in shaft 114 are sized to receive threaded shanks 414 (FIG. 4B) of stops 412. In contrast, head 416 (FIG. 4B) of stop 412 is too large to fit into shaft bore 410. Moreover, head 416 (FIG. 4B) is sized to allow lower tier hub 158 (FIG. 1A), middle tier hub 148 (FIG. 1A), or upper tier hub 126 (FIG. 1A) to rest upon it when threaded shank 414 (FIG. 4B) of stop 412 is threaded into shaft bore 410. Head 416 (FIG. 4B) provides an obstruction of such size that the central aperture of lower tier hub 158 (FIG. 3), middle tier hub 148 (FIG. 1A), and upper tier hub 126 (FIG. 1A) is too small to pass over stop 412 when it is affixed to shaft 114 via shaft bore 410. Each of three stops 412 threads into one of the shaft bores 410 to provide a support upon which its respective tier (i.e., lower tier 116 (FIG. 1A), middle tier 118 (FIG. 1A), or upper tier 120 (FIG. 1A)) will rest.

The threaded design of shaft bores 410 and stops 412 allows a user of article organizer 110 (FIG. 1A) to determine the height of each of the tiers by threading the tier's respective stop 412 into the shaft bore 410 located closest to the desired height of the tier. Furthermore, the threaded design allows the height of each level to be changed at any time, thereby accommodating varying uses of article organizer 110 (FIG. 1A) or storage of varying types of articles. Although the preferred embodiment of the present invention includes shaft bores 410 that penetrate three-fourths through shaft 114, alternate embodiments are envisioned wherein shaft bores 410 penetrate completely through shaft 114 allowing stop 412 to protrude from two sides of shaft 114. Or, alternatively, an alternate embodiment includes two or more shaft bores 410 penetrating multiple sides of shaft 114 at the same vertical height to allow a corresponding number of stops 412 to be placed around the perimeter of shaft 114 to provide multiple points of support for the respective tier. In yet another embodiment, shaft bore 410 and stop 412 are not threaded. Rather, stop 412 is simply inserted into shaft bore 410 via application of pressure.

Figure 5:
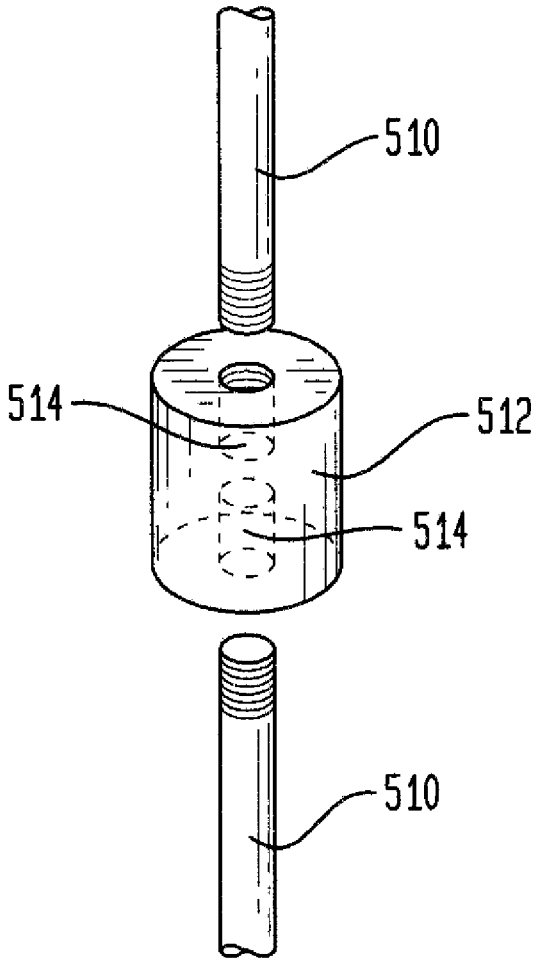
FIG. 5 is an exploded view of a threaded connector and portions of two shaft segments in accordance with an alternate embodiment of the present invention in which threaded connectors replace the shaft bores and stops.

FIG. 5 shows an alternate embodiment for supporting each of lower, middle, and upper tiers 116, 118, and 120, respectively (FIG. 1A). In this alternate embodiment, stops 412 (FIGS. 4A, 4B) and shaft bores 410 (FIGS. 4A, 4B) are not used. Rather, shaft 114 is created from multiple shaft segments 510 coupled to each other via threaded connector 512. In this embodiment, connector 512 is a cylinder having bores 514 in its upper and low ends, as depicted in FIG. 5, such that a threaded end of shaft segment 510 may be threaded into one of the upper or lower bores 514 of connector 512. Bores 514 are positioned within connector 512 such that when the ends of adjacent shaft segments 510 have been received in each of the two bores 514 of connector 512, the central axes of the two adjacent shaft segments 510 align to form a single, straight cylindrical shaft.

Moreover, connector 512 is sized to allow lower tier hub 158 (FIG. 1A), middle tier hub 148 (FIG. 1A), or upper tier hub 126 (FIG. 1A) to rest upon its upper end, yet providing an obstruction of such size that the central aperture of lower tier hub 158 (FIG. 1A), middle tier hub 148 (FIG. 1A), and upper tier hub 126 (FIG. 1A) is too small to pass over connector 512. Each of three connectors 512 connects adjacent shaft segments 510 and provides a support upon which its respective tier (i.e., lower tier 116, middle tier 118, or upper tier 120) will rest.

Adjacent shaft segments 510 have varying lengths such that a user may select an appropriate length to position connector 512 at the desired height above either base 112 (FIG. 1A) or another connector 512. For example, when choosing a first shaft segment 510 to be threaded into brace 210 (FIGS. 2A, 2B) and connected on its upper end to connector 512 that will support lower tier 116, a user shall make a decision regarding the desired height of lower tier 116 with respect to brace 210 (FIGS. 2A, 2B). Thereafter, a user shall choose a shaft segment 510 having a length equal to or closest to the desired height of lower tier 116 above brace 210 (FIGS. 2A, 2B). Similarly, when choosing a second shaft segment 510 and connector 512 for supporting middle tier 118, a user shall determine the desired height of middle tier 118 with respect to the connector 512 that supports lower tier 116. Thereafter, a user shall choose a shaft segment 510 having a length equal to the desired height of middle tier 118 with respect to lower tier 116. The vertical heights of all additional tiers are determined in a similar manner. In this manner, article organizer 110 (FIG. 1A) may be configured as desired by the user (i.e., quantity of tiers, height of tiers, specific combination of varying types of tiers, etc.).

Figure 6:
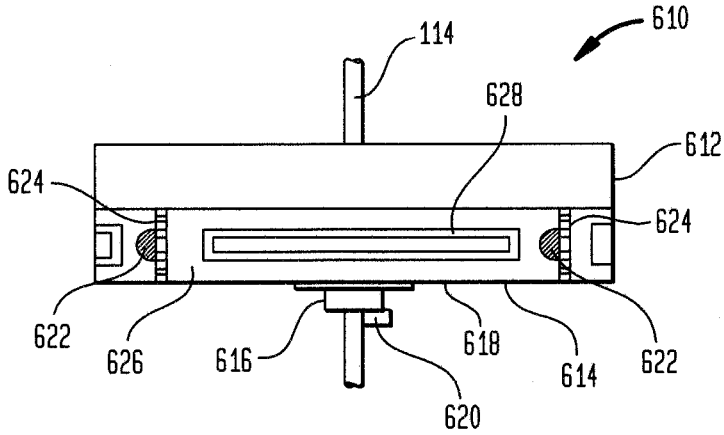
FIG. 6 is a perspective view of a tier of the article organizer in accordance with an alternate embodiment of the present invention including, inter alia, multiple drawers attached via respective hinges and having indents to facilitate opening and closing of the respective drawer.

Referring now to FIG. 6, depicted is an alternate embodiment for any of the tiers (e.g., upper tier 120, middle tier 118, or lower tier 116) discussed above. For this alternate embodiment, alternate tier 610 includes two vertically stacked units, namely upper and lower units 612 and 614, respectively. However, additional embodiments are envisioned in which alternate tier 610 includes more than two vertically stacked units. Upper unit 612 is affixed to lower unit 614 in a stationary manner such that rotation of either upper or lower unit 612 or 614, respectively, rotates both units. However, other embodiments are envisioned in which upper unit 612 couples to lower unit 614 such that each of the upper and lower units 612 and 614, respectively, rotates independently.

Figure 7:
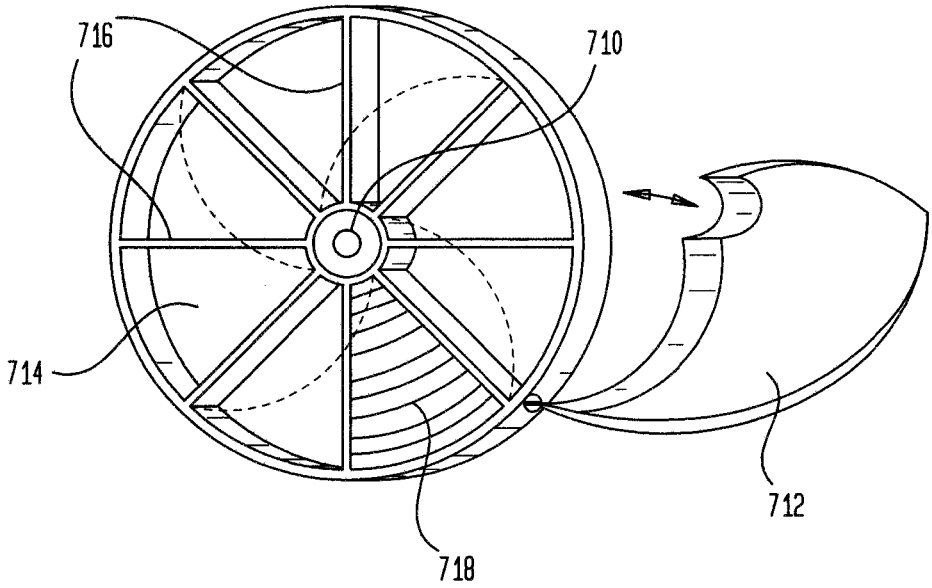
FIG. 7 is a top plan view of the tier shown in FIG. 6 in accordance with an alternate embodiment of the present invention illustrating upper compartments and lower drawers. One of the upper compartments is illustrated with a ring insert, and one of the lower drawers is illustrated in an open position.

Upper and lower units 612 and 614, respectively, attach to shaft 114 via alternate tier hub 616. For ease of manufacturing, alternate tier hub 616 is identical to upper, middle, and lower tier hubs 126, 148, and 158, respectively (FIG. 1A). Similar to lower, middle, and upper tiers 116, 118, and 120, respectively, upper and lower units 612 and 614, respectively, include a central aperture. The central portion of downwardly facing surface 618 of lower unit 614 is affixed to the upwardly facing surface of alternate tier hub 616 such that the central aperture of alternate tier hub 616 aligns with the central apertures of upper and lower units 612 and 614, respectively, to create alternate tier aperture 710 (FIG. 7). Shaft 114 may then pass through alternate tier aperture 710 (FIG. 7) in the same manner that shaft 114 passes through aperture 138 (FIG. 1A) as discussed above with respect to FIG. 1A. Furthermore, alternate tier 610 is coupled to shaft 114 by sitting atop alternate tier stop 620, which is inserted into one of shaft bores 410 (FIGS. 4A, 4B). Consequently, alternate tier 610 rotates freely about shaft 114.

Lower unit 614 includes a plurality of drawers 712 (FIG. 7), as discussed in greater detail below with respect to FIG. 7. Each drawer 712 (FIG. 7) includes a respective indent 622 and hinge 624. One outside corner of drawer 712 (FIG. 7) is attached via hinge 624 to the frame of lower unit 614 such that each drawer 712 (FIG. 7) may be rotated about hinge 624 until it is completely external to lower unit 614, thereby allowing a user to easily view, remove, or insert articles to drawer 712 (FIG. 7). Drawer face 626 includes indent 622 to facilitate rotation of drawer 712 (FIG. 7) with respect to hinge 624 allowing drawer 712 (FIG. 7) to be opened and closed with respect to lower unit 614. In place of indent 622, a knob may be affixed to drawer face 626 to perform the same function as indent 622. Drawer 712 further includes holder 628 that accepts a label that may be used to identify drawer 712.

Although drawer 712 (FIG. 7) is attached to the frame of lower unit 614 via hinge 624, other methods of inserting and removing drawer 712 (FIG. 7) from lower unit 614 are possible. For example, a sliding mechanism could be affixed to the downwardly facing side of drawer 712 (FIG. 7) and a track could be affixed to the upwardly facing side of the floor of lower unit 614 such that drawer 712 (FIG. 7) slides along the track during insertion or removal of drawer 712 (FIG. 7) with respect to lower unit 614.

Referring next to FIG. 7, upper unit 612 (FIG. 6) includes alternate compartments 714 that are formed by interior walls 716 of upper unit 612 (FIG. 6). Each alternate compartment 714 has a solid bottom. One or more of alternate compartments 714 may contain ring holder 718, which may be removably inserted into any one of alternate compartments 714 by a user. Alternatively, ring holder 718 may be attached in a stationary manner to the floor of alternate compartment 714. Each alternate compartment 714 may have an entirely open upwardly facing surface. Or, one or more individual alternate compartments 714, or groups of alternate compartments 714, may be equipped with lids to protect alternate compartment 714 from dirt, moisture, and other environmental contaminants.

Although the alternate embodiment has been described with one upper unit 612 (FIG. 6) and one lower unit 614 (FIG. 6), other embodiments exist with varying quantities of upper and lower units 612 and 614, respectively, (FIG. 6)(e.g., zero upper units 612 (FIG. 6), zero lower units 614 (FIG. 6), a plurality of lower units 614 (FIG. 6) with none or one upper unit 612 (FIG. 6), etc.).

While the present invention has been described with reference to one or more preferred embodiments, which embodiments have been set forth in considerable detail for the purposes of making a complete disclosure of the invention, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention.

The invention claimed is:

1. An apparatus for organizing articles comprising:

at least one shaft;

at least one first tier coupled to said shaft and including at least one spoke; and at least one second tier coupled to said shaft and including a plurality of compartments, at least one of said plurality of compartments including at least one openable lid;

wherein said articles may be suspended from said spoke; and wherein said articles may be stored in said plurality of compartments.

2. An apparatus according to claim 1, wherein heights of said first tier and said second tier with respect to said shaft are adjustable.

3. An apparatus according to claim 1, said apparatus further comprising:

a plurality of bores located at varying vertical heights along said shaft and having at least a portion of said bore located internal to said shaft; and at least one stop for mating with at least one of said bores;

wherein at least one of said first and second tiers is coupled to said shaft via said stop.

4. An apparatus according to claim 3, wherein at least one of said bores and at least one of said stops is threaded.

5. An apparatus according to claim 1, said apparatus further comprising:

at least one connector having at least one connector bore;

wherein said connector bore mates with at least one shaft end of at least one of said shafts; and wherein at least one of said first and second tiers is coupled to said shaft via said connector.

6. An apparatus according to claim 5, wherein at least one of said connector bores and at least one of said shaft ends is threaded.

7. An apparatus according to claim 1, said apparatus further comprising:

a handle coupled to said shaft;

wherein said facilitates at least one of the group consisting of transportation of said apparatus, mounting said apparatus to a lateral surface, mounting said apparatus to an overhead surface, and combinations thereof.

8. An apparatus according to claim 1, wherein at least one of said spokes has a shape that is one of the group consisting of straight, jagged, sawtooth, wavy, spiral, sinusoidal, arced, and combinations thereof.

9. An apparatus according to claim 1, wherein at least one of said spokes includes at least one valley.

10. An apparatus according to claim 1, said apparatus further comprising:

a base coupled to said shaft for supporting said shaft on a horizontal surface.

11. An apparatus according to claim 10, said apparatus further comprising:

a brace for coupling said shaft to said base.

12. An apparatus according to claim 11, wherein said brace and at least one end of said shaft are threaded.

13. An apparatus according to claim 1, wherein at least one of said first and second tiers rotates with respect to said shaft.

14. An apparatus according to claim 1, wherein at least one of said compartments includes at least one of the group consisting of a holder, a hinge, a ring insert, and combinations thereof.

15. An apparatus according to claim 1, wherein said second tier comprises at least two levels.

* * * * *